US011396783B2

(12) United States Patent
Younger

(10) Patent No.: US 11,396,783 B2
(45) Date of Patent: Jul. 26, 2022

(54) DOWNHOLE TOOL WITH A PROPELLANT CHARGE

(71) Applicant: SPEX CORPORATE HOLDINGS LTD., Aberdeenshire (GB)

(72) Inventor: Rae Younger, Aberdeenshire (GB)

(73) Assignee: SPEX CORPORATE HOLDINGS LIMITED, Aberdeen (GB)

( * ) Notice: Subject to any disclaimer, the term of this patent is extended or adjusted under 35 U.S.C. 154(b) by 0 days.

(21) Appl. No.: 17/018,996

(22) Filed: Sep. 11, 2020

(65) Prior Publication Data

US 2021/0025255 A1 Jan. 28, 2021

Related U.S. Application Data

(63) Continuation of application No. 15/565,497, filed as application No. PCT/GB2016/051032 on Apr. 13, 2016, now abandoned.

(30) Foreign Application Priority Data

Apr. 13, 2015 (GB) ..... 1506265

(51) Int. Cl.
*E21B 29/02* (2006.01)
*E21B 23/04* (2006.01)
(Continued)

(52) U.S. Cl.
CPC ..... *E21B 29/02* (2013.01); *E21B 7/04* (2013.01); *E21B 23/04* (2013.01); *E21B 29/06* (2013.01)

(58) Field of Classification Search
CPC ..... E21B 23/04; E21B 29/02; E21B 29/06; E21B 7/04
See application file for complete search history.

(56) References Cited

U.S. PATENT DOCUMENTS 2,918,125 A 12/1959 Sweetman
3,318,395 A * 5/1967 Messmer ..... E21B 29/02 175/14
(Continued)

FOREIGN PATENT DOCUMENTS

WO 2007/049026 A1 5/2007
WO 2016/007182 A1 1/2016
(Continued)

OTHER PUBLICATIONS

UK Search Report dated Mar. 1, 2019 for corresponding GB Application No. 1716580.4.
(Continued)

*Primary Examiner* — Caroline N Butcher
(74) *Attorney, Agent, or Firm* — Tarolli, Sundheim, Covell & Tummino LLP

(57) ABSTRACT

A method of removing material from a target is described. The method comprises the steps of providing a tool, the tool having at least one propellant source; pressurising the tool to a pressure higher than the environmental pressure; igniting at least one of the propellant source(s) to form a combustion zone; and directing combustion products generated at the combustion zone along at least one tool flow path. The tool flow path(s) is selectively openable or closable, such that upon exiting the tool flow path(s) the combustion products interact with a target, the interaction causing material to be removed from the target.

46 Claims, 6 Drawing Sheets

(51) Int. Cl.
*E21B 29/06* (2006.01)
*E21B 7/04* (2006.01)

(56) References Cited

U.S. PATENT DOCUMENTS

| | | | | |
|---|---|---|---|---|
| 4,180,131 | A | 12/1979 | Chammas | |
| 4,298,063 | A | 11/1981 | Regalbuto et al. | |
| 4,352,397 | A | 10/1982 | Christopher | |
| 4,391,337 | A | 7/1983 | Ford et al. | |
| 4,446,920 | A * | 5/1984 | Woytek | E21B 29/02 149/108.2 |
| 4,598,769 | A | 7/1986 | Robertson | |
| 6,024,169 | A | 2/2000 | Haugen | |
| 6,155,343 | A * | 12/2000 | Nazzal | E21B 29/00 166/222 |
| 2003/0070812 | A1 | 4/2003 | Robertson | |
| 2005/0126783 | A1 | 6/2005 | Grattan et al. | |
| 2008/0257549 | A1 | 10/2008 | Swor et al. | |
| 2013/0126153 | A1 | 5/2013 | Baker | |
| 2014/0144702 | A1 | 5/2014 | Walker | |
| 2014/0238678 | A1 | 8/2014 | Arrell, Jr. et al. | |
| 2014/0262328 | A1 | 9/2014 | Robertson | |

FOREIGN PATENT DOCUMENTS

| | | | | |
|---|---|---|---|---|
| WO | WO-2016007182 | A1 * | 1/2016 | E21B 29/02 |
| WO | 2016/069305 | A1 | 5/2016 | |
| WO | 2016/166531 | A2 | 10/2016 | |

OTHER PUBLICATIONS

International Search Report dated Aug. 30, 2016 for corresponding International application No. PCT/GB2016/051032.
International Search Report corresponding to PCT/GB2016/051032 dated Oct. 26, 2017, pp. 1-14.

* cited by examiner

DOWNHOLE TOOL WITH A PROPELLANT CHARGE

RELATED APPLICATIONS

The present invention is a Continuation of U.S. patent application Ser. No. 15/565,497, filed Oct. 17, 2017, which is U.S. National Stage under 35 USC 371 patent application, claiming priority to Serial No. PCT/GB2016/051032, filed on 13 Apr. 2016; which claims priority from 1506265.6, filed 13 Apr. 2015, the entirety of both of which are incorporated herein by reference.

FIELD OF THE INVENTION

The present invention relates to the field of manipulation of a material. The present invention finds particular application in the oil and gas industry and is particularly suitable for the manipulation of solid materials.

BACKGROUND TO THE INVENTION

There are situations in which it is desirable to initiate a change in the target material particularly in remote locations such as inside an oil or gas well. The change may be a change to one or more of temperature, structure, position, composition, phase, physical properties and/or condition of the target or any other characteristic of the target.

A typical situation may be to sever a tubular in a well, clean a downhole device or tubulars, initiate a downhole tool or remove an obstruction.

Conventional tools perform these operations with varying degrees of success but generally they are not particularly efficient and make such operations expensive and time consuming. They may additionally have associated ancillary equipment that is cumbersome or may attract stricter logistical or regulatory controls.

SUMMARY OF THE INVENTION

According to a first aspect of the present invention there is provided a method of initiating a change in a target, the method comprising the steps of:

providing at least one propellant source, igniting at least one of the propellant source(s) to form a combustion zone, and directing combustion products generated at the combustion zone along at least one flow path, such that upon exiting the flow path(s) the combustion products interact with a target, the interaction causing a change in the target.

In at least one embodiment of the present invention, the invention provides a method of using combustion products (which includes propellant gas) generated from burning a propellant source to interact with a target to cause a change in the target. For the avoidance of doubt, the combustion zone is the portion of the propellant source which is ignited at any given moment.

A propellant is a material which has a low rate of combustion and once ignited burns or otherwise decomposes to produce propellant gas. This gas is highly pressurised, the pressure driving the gas and other combustion products away from the propellant, forming a stream of combustion products. A propellant can burn smoothly and at a uniform rate after ignition without depending on interaction with the atmosphere, and produces propellant gas and/or heat on combustion and may also produce additional combustion products. Generally, a propellant is classed as an explosive material.

The change in the target may be a change in temperature, structure, position, composition, phase, physical properties and/or condition of the target or any other characteristic of the target.

The change in the target may be to, for example, ablate, erode, impact, clean and/or transmit heat to the target.

The combustion products may create a chemical reaction in the target.

The change in the target may be at least partially permanent.

The change in the target may be at least partially temporary.

The target may be a physical object such as a casing, valve, pipeline etc.

The at least one propellant source may be part of a tool.

In some embodiments, the target may be an environment surrounding the tool. In these embodiments the change might be to reduce oxygen in the environment or create a partial vacuum in the environment.

The method may further include the step of pressurising the tool to higher pressure than the environmental pressure. In at least one embodiment, such an arrangement permits greater propulsion to be achieved and erosion of the target by the combustion products.

The step of directing combustion products generated at the combustion zone along at least one flow path may be at least partially continuous.

The step of directing combustion products generated at the combustion zone along at least one flow path may be at least partially intermittent.

The interaction with the target may be one or more of, for example, severing the target, crushing the target, vibrating the target, skimming the target, applying a pressure to the target, hitting the target and/or propelling or moving the target. Alternatively or additionally, the interaction with the target may be changing any other characteristic of the target, for example injecting fluid into the target to reduce density, increasing the temperature of the target, melting the target, welding the target, oxidising the target, etc.

The flow path may be linear. Alternatively the flow path may be convoluted.

The flow path may have a single exit. In alternative embodiments the flow path may have multiple exits.

The combustion products may exit the flow path subsonically. Alternatively the combustion products may exit the flow path supersonically.

The flow path may define a flow path profile, the flow path profile may be adapted to create a change in a combustion product parameter. Particularly, the flow path may be able to create an increase in pressure of the combustion products. Alternatively the flow path may be able to create a decrease in pressure of the combustion products.

In other embodiments the flow path may be able to increase and/or decrease the speed or temperature of the combustion products. In other embodiments the flow path may be able to increase and/or decrease any other parameter of the combustion products.

There may be multiple flow paths. Where there are multiple flow paths, at least some of the flow paths may converge into a single flow path.

Alternatively a single flow path may diverge into multiple flow paths.

The flow path(s) may be thermally insulated.

The flow path(s) may have variable cross-section.

The flow path(s) may include one or more restrictions. The restriction(s) may be movable with respect to the flow path(s) to create combustion products pulses. The restriction(s) may define a reduced flow path(s) cross section. The restriction(s) may define a varying flow path cross section.

The flow paths may be selectively opened or closed.

There may be a plurality of propellant sources, each propellant source directing combustion products towards the combustion products generated by another propellant source. In one embodiment of this arrangement, upon impact, the combustion products from the propellant sources will deflect off each other. Such an arrangement can be used to change the direction of two axial jets of combustion products into radial scatter of combustion products.

The method may further comprise the step of providing at least one additive.

The additive(s) may be an abrasive or any other material or combination of materials that may have a purpose such as plugging material, metal repair material, activation material, dissolving agent, gelling agent, chemical tracer, radioactive material and stabilising material.

The additive(s) may comprise a liquid.

Alternatively or additionally, additive(s) may comprise a gas.

Alternatively or additionally the additive(s) may comprise a solid.

Alternatively or additionally the additive(s) may comprise an encapsulated material.

Alternatively or additionally, the additive(s) may comprise a particulate material.

In one embodiment the additive may be a heat transfer material. By heat transfer material it is meant a material which can hold heat and transfer it to another object, in this case the target, upon impact with the object.

In this embodiment, the additive may adhere to the target.

The additive(s) may be non-combustible.

In certain embodiments the additive(s) may be combustible.

In some embodiments the additive(s) may be saturated steam.

The method may comprise the step of introducing the additive(s) to the generated combustion products.

The additive(s) may be introduced to the combustion products through a feed. The feed may be at least one flow path inlet.

Alternatively or additionally the additive(s) may be introduced to the combustion products at or adjacent to the flow path(s) exit.

The method may alternatively or additionally comprise the step of passing the combustion products over a surface containing at least one additive. In such an embodiment, the combustion products can lift the additive(s) off the surface or the additive can be released into the combustion products by the directed combustion products wearing away the additive-containing surface. Alternatively, in such an embodiment, the combustion products can bond the additive(s) into the surface or cause the additive(s) to react with or pass through the surface material.

The method may comprise the step of providing a tool sacrificial portion. The tool sacrificial portion may be, for example, eroded by the directed combustion products, particles and/or portions of the sacrificial portion becoming part of the combustion products.

The method may alternatively or additionally comprise the step of providing at least one additive in the propellant source.

The generated combustion products may be directed by a containment arrangement.

The combustion zone may be contained by the containment arrangement.

The containment arrangement may be defined by the propellant source.

The/each propellant source may be hollow.

The combustion zone may be formed on a propellant source internal surface.

In such an arrangement, the combustion zone may be contained at least partially by the propellant source.

Alternatively or additionally the combustion zone may be formed on a propellant source external surface.

Alternatively or additionally the containment arrangement may be defined by a tool body.

The combustion zone may be contained at least partially by the tool body.

Alternatively or additionally the combustion zone may be contained at least partially by a body external to the tool.

Alternatively or additionally the combustion zone may be contained at least partially by a body internal to the tool.

The propellant source may be solid. Alternatively or additionally, the propellant source may be liquid or gas. In other embodiments, the propellant source may be mixture of solid and liquid material.

The propellant source may be a cold flame propellant.

The propellant source may be a flameless propellant.

The propellant source may generate combustion products at high temperature.

The propellant source may be shaped to combust at a substantially constant rate.

The propellant source may contain multiple propellant types.

The propellant types may be homogeneous.

The propellant source may comprise a laminated section of layers, for example, of propellants of different burn rates. The propellant source may be configured to achieve a desired combustion rate. The geometry of solid propellant may be adjusted to decrease or increase the propellant combustion rate. This may be achieved by modifying the surface area which combusts (for example a star-shaped cross-section will burn faster than an equivalent size of solid cylindrical propellant). The propellant combustion rate may remain constant or may increase or decrease during operation. Equally the combustion rate can be controlled by segments or layers of different propellants burning at different rates.

The step of igniting the propellant source may form a plurality of combustion zones.

The propellant source may define a surface, at least a portion of the surface being adapted to permit the formation of a combustion zone.

The propellant source may be shaped to provide a variable surface area.

Upon ignition, the combustion zone may spread over the propellant source surface.

The combustion zone may spread rapidly over the propellant surface.

In some embodiments, the propellant source may be fed to the combustion zone.

The generated combustion products may exit the flow path in a preferred direction.

The method may further comprise the step of moving the tool with respect to the target. Such an arrangement permits the interaction with the target to take place at different locations on the target.

Alternatively or additionally, the method may comprise the step of varying the direction of the combustion products exiting the flow path with respect to the tool. Being able to vary the angle and/or direction of the combustion products exiting the flow path allows, for example, profiles to be cut in a target. The angle and/or direction of the combustion products exiting the flow path could be controlled by computer numerical control methods, for example.

The method may comprise the step of directing the combustion products generated at the combustion zone in a radially inwards direction.

Alternatively or additionally, the method may comprise the step of directing the combustion products generated at the combustion zone in a radially outwards direction.

The method may comprise the step of directing the combustion products generated in an axial direction.

The method may comprise the step of deflecting the generated combustion products prior to exiting the flow path.

The method may comprise forming at least one combustion products jet.

The method may comprise forming a plurality of combustion products jets.

The method may comprise merging one or more combustion products jets to form a single combustion products jet.

The method may comprise creating pulses of generated combustion products. In at least one embodiment of the present invention creating pulses of combustion products conveniently enables transmission of vibration to the target and the creation of vibration in the target.

The method may comprise creating a sequence of combustion products jets.

The sequence of combustion products jets may be pulses. In at least one embodiment of the present invention a sequence of pulses is created whereby different pulses have different temperatures and pressures so that a target with different layers can be cut or eroded.

The sequence of combustion products jets may be created and/or controlled with a computer program for example.

The method may comprise the step of cooling the target.

The method may comprise subjecting the target to thermal stress and/or thermal shock imparted partially with the generated combustion products. In at least one embodiment of the present invention cement, associated with the wellbore, can be reduced to rubble by applying thermal stress without the need to use electrically driven tools.

The combustion products may interact directly with the target.

The combustion products may interact indirectly with the target.

The combustion products may be adapted to propel an object or material into, adjacent to or through the target.

The object or material may be capable of severing the target, crushing the target, vibrating the target, skimming the target, hitting the target and/or penetrating the target. Alternatively or additionally, the object or material may change any other characteristic of the target.

According to a second aspect of the present invention there is provided a tool for initiating a change in a target, the tool comprising:

at least one propellant source, at least one mechanism for igniting the propellant source(s), and at least one flow path, wherein, upon ignition, at least one of the/each propellant source(s) combusts to release combustion products which, in use, flow out of the tool along the flow path towards a target to be changed.

It will be understood that features listed as non-essential with regard to one aspect may be equally applicable to any other aspect.

BRIEF DESCRIPTION OF THE DRAWINGS

Embodiments of the invention will now be described, by way of example only, with reference to the following drawings, in which:

FIG. 2 comprising

FIG. 4 comprising

DETAILED DESCRIPTION OF THE DRAWINGS

Figure 1:
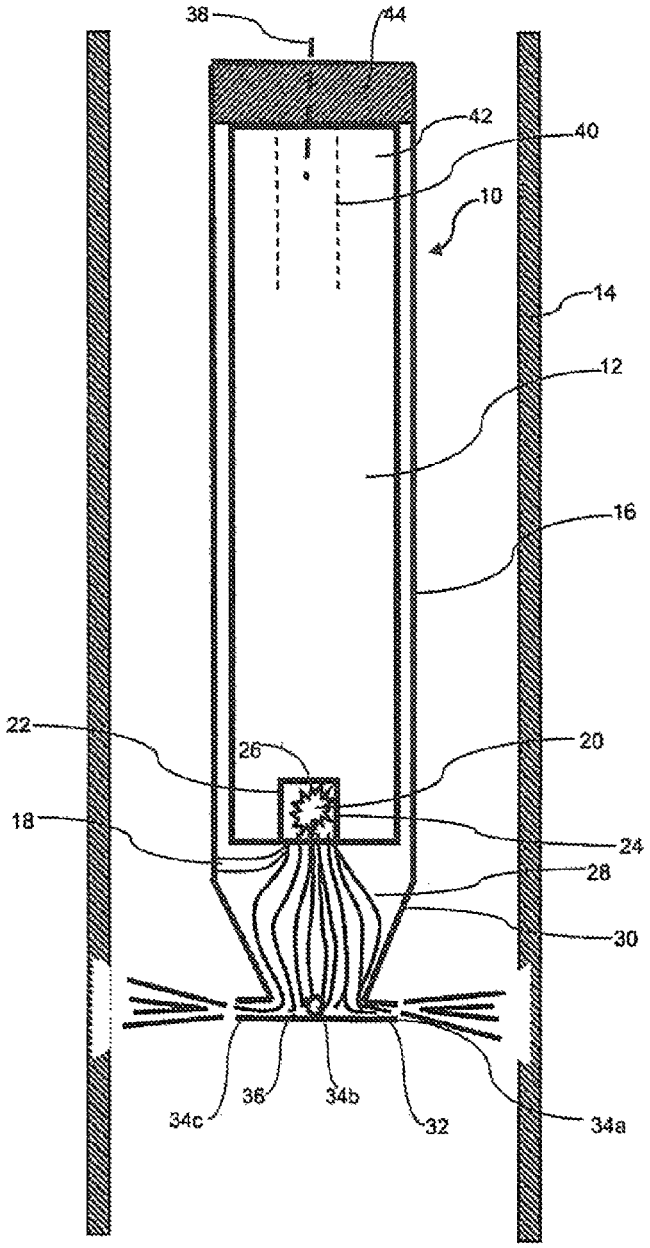
FIG. 1 shows a schematic section of a tool comprising a propellant source cutting a casing according to a first embodiment of the invention.

Reference is first made to FIG. 1 which shows a schematic section of a tool, generally indicated by reference numeral 10, comprising a propellant source 12 for cutting a casing 14 according to a first embodiment of the present invention.

The propellant source 12 is housed within a tool body 16. The tool 10 further includes an ignition mechanism 18 for igniting the propellant source 12. The propellant source 12 includes a cylindrical ignition recess 22 where the ignition mechanism ignites the propellant source 12. In FIG. 1 the propellant source 12 has already been ignited creating a combustion zone 20 inside the ignition recess 22. Particularly the ignition recess sidewall 24 and end wall 26 are supporting propellant combustion.

This combustion produces combustion products 28 which are propelled out of the ignition recess 22 and into a flow path 30 defined by the tool body 16. The flow path 30 narrows to a nozzle head 32 with four nozzles 34 (only three of the nozzles 34*a*, 34*b*, 34*c* are visible in FIG. 1), the combustion products 28 deflecting off a tool endwall 36 and out of the nozzles 34.

The nozzles 34 direct the combustion products 28 out of the tool 10 at 90° to a tool longitudinal axis 38 and onto casing 14. The combustion products 28 are extremely hot and melt the casing 14. The tool 10 is rotated so that the combustion products 28 exiting the nozzles 34 melt the entire circumference of the casing 14.

The propellant source 12 is substantially solid however incorporates two different propellant materials. There is a central cylindrical core 40 of fast burning propellant and an outer layer 42 of slower burning propellant, the core 40 and the outer layer 42 being arranged concentrically.

Upon ignition, the combustion zone 20 primarily burns away the central core 40 of the propellant source 12 to rapidly increase the surface area of the propellant which forms the combustion zone 20. The propellant source 12 is secured in the tool 10 by a tool cap 44, once the cylindrical core 40 of propellant is burnt away, the tool cap 44 prevents combustion products 28 from escaping out of the top of the propellant source 12 and directs the combustion products 28 back down the propellant source 12 towards the flow path 30.

With the central core 40 burnt away, the combustion zone 20 is fed by the slower burning propellant 42. As the slower burning propellant 42 burns, the combustion zone 20 increases as the surface area exposed by the propellant combustion increases. This in turn increases the intensity of the combustion products generated and the subsequent flow of combustion products 28 through the nozzles 34.

Referring now to FIG. 2 comprising FIGS. 2*a* to 2*d*, four different propellant sources 12*a*, 12*b*, 12*c*, 12*d* are shown in cross-section for use with the tool 10 according to second, third, fourth and fifth embodiments of the invention.

Figure 2A:
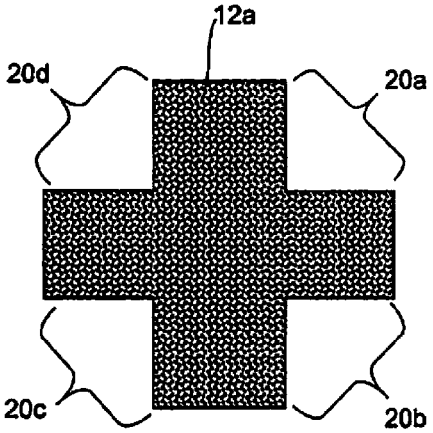
FIGS. 2*a* to 2*d*, show cross sections of solid propellant sources to perform methods according to embodiments of the present invention.

Each of the propellant sources 12*a-d* have a constant cross-section and each burn in a slightly different way. FIG. 2*a* shows a propellant source 12*a* which can support four combustion zones 20*a-d* and create four streams of combustion products which can either be merged by the flow path 30 in the tool FIG. 1 or travel down different flow paths in a different tool according to another embodiment.

Figure 2B:
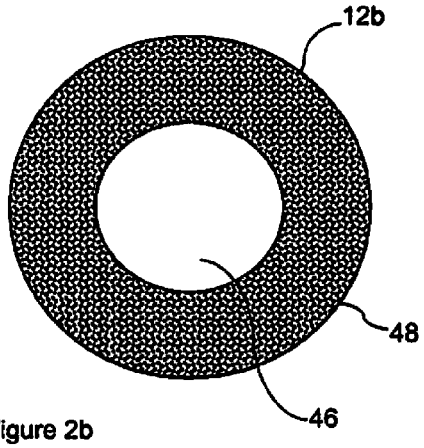

The propellant source 12*b* in FIG. 2*b* defines a central void 46 which can support a combustion zone, similar to the propellant source 12 in FIG. 1. This propellant source 12*b* could also support a combustion zone on its external surface 48.

Figure 2C:
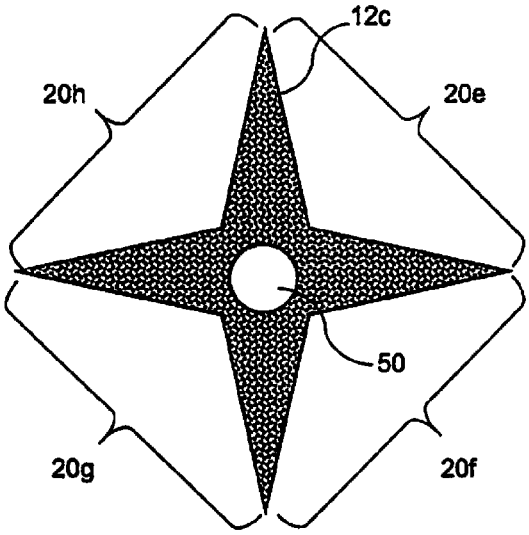

The propellant source 12*c* in FIG. 2*c* is similar to the propellant source in FIG. 2*a*. However the source 12*c* has been designed to provide increased surface area for the combustion zones 20*e-h*. This source 12*c* can also support an internal combustion zone in its central void 50.

Figure 2D:
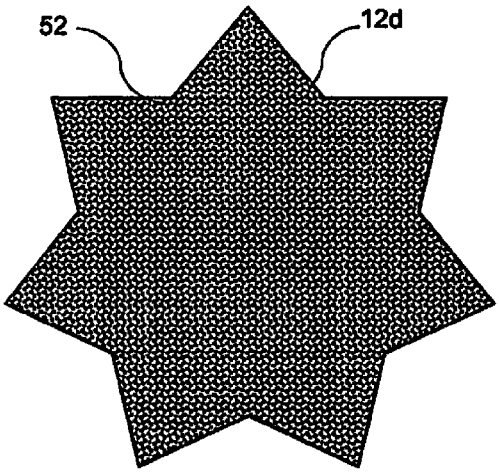

The external surface 52 of the propellant source 12*d* in FIG. 2*d* again defines an increased surface area to increase the size of the combustion zone the source 12*d* can support leading to an increased intensity of combustion products.

The heat, pressure or temperature, for example, induced in the target by the combustion product jets could be used to trigger a chemical reaction.

Various modifications and improvements may be made to the above-described embodiment without departing from the scope of the invention. For example, the combustion products could be used to remove scale, halite or salt, corrosion products, wax or debris from, amongst other things, a wellbore, well bore completion equipment, pipeline, pipework, instrumentation, production/processing equipment, downhole equipment (e.g. pressure gauge), sandscreens, downhole perforations et cetera.

The combustion products generated by the tool of the first embodiment could be used to expand a piece of downhole equipment, such as a sand screen.

The combustion products generated by the tool of the first embodiment could cure cement, particularly cement which is behind the wellbore casing, securing the casing to the borehole wall.

In other embodiments, the tool may be used to activate a remote device or tool or energise a plug by, for example, moving a switch or a valve by pressure or heat; or by creating a fluid flow by suction or pressure to drive a turbine, for example, to generate power. Power generated this way could be stored in a downhole battery.

The propellant could be used to drive a fluid or a solid into, for example, a formation or along a tubular.

Figure 3:
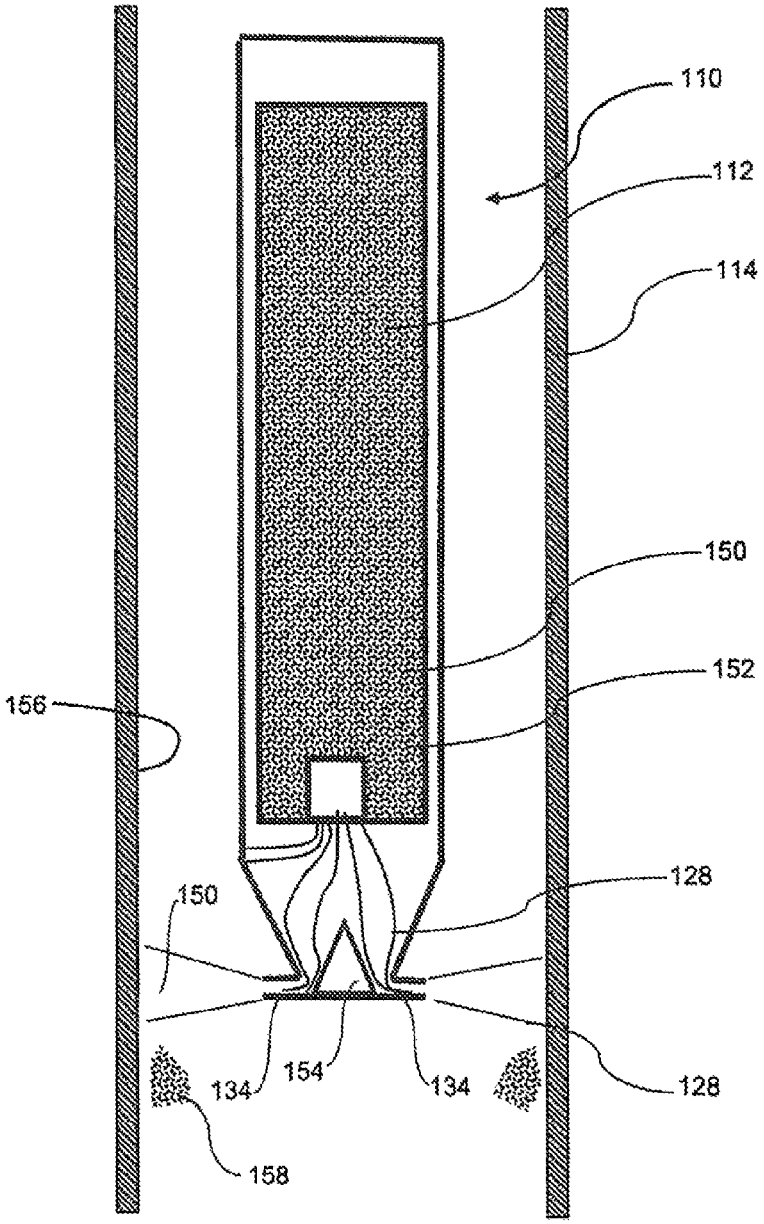
FIG. 3 is a schematic section of a tool comprising a propellant source skimming a tubular according to another embodiment of the present invention.

Reference is now made to FIG. 3 which shows a schematic of the tool 110, comprising a propellant source 112 for cleaning rust off the casing 114 according to a second embodiment of the present invention.

The tool 110 is similar to the tool 10 of the first embodiment. However in this tool, the propellant source 112 is a composite of an abrasive additive 150 in a matrix of solid propellant 152.

The tool 110 also includes a deflector plate 154 which assists in deflecting the flow of combustion products 128 out through the nozzles 134. The combustion products flow through the nozzles 134 carrying the abrasive additive which scours the surface 156 of the casing 114, removing particles of rust 158 in the process.

Various modifications and improvements may be made to the above-described embodiment without departing from the scope of the present invention. For example, the deflector plate 154 or the nozzles 134 could be made of an additive, in addition to or instead of the additive 150 within the propellant source 112. The additive in the deflector plate 154 or the nozzles 134 could be picked up by the stream of combustion products 128 as they flow through the tool 110.

In another embodiment, a Venturi tube could be fitted into the deflector plate such that one end is in the stream of combustion products and the other end is adjacent to the rust particles coming off the casing wall. In this embodiment, the stream of combustion products passing the end of the Venturi tube would apply a suction force on the Venturi tube, allowing the tool to suck the rust particles 158 into the stream of combustion products to further add to the abrasive effect of the tool.

The additive may be more substantial in nature. The additives could be blades to be propelled into the target to weaken the target, or shot to perforate, for example, the target. The additive could be encapsulated liquid which vaporises under the high pressures and temperatures in a rock formation to create cracks.

Alternatively or additionally, the additive could be wedge shaped to wedge cracks in the rock formation. The additive could be a thermosetting plastic which could be sent into the formation by the propellant and cured in the formation by the heat of the propellant.

The additive could induce a chemical reaction with the target.

Figure 4A:
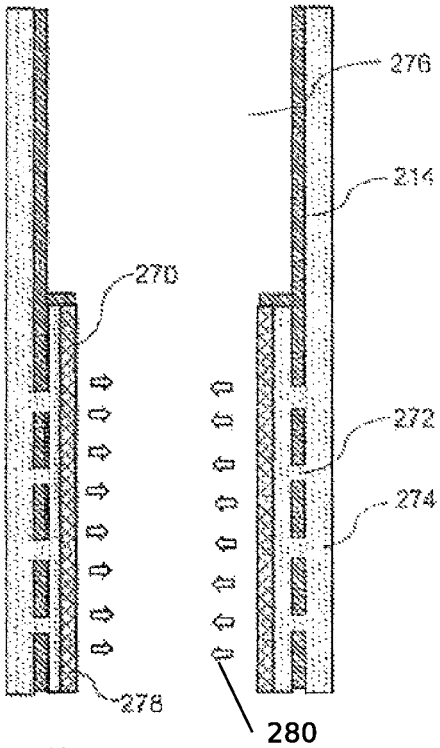
FIGS. 4*a*, 4*b* and 4*c* are a series of schematic sections of a process of cleaning a sand screen using a propellant source to enhance oil production according to another embodiment of the present invention.
Figure 4B:
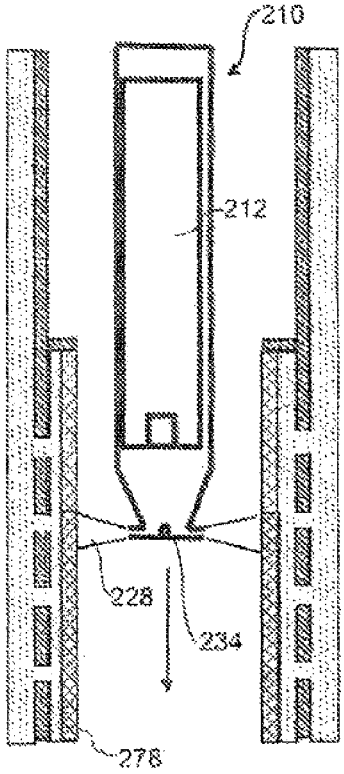
Figure 4C:
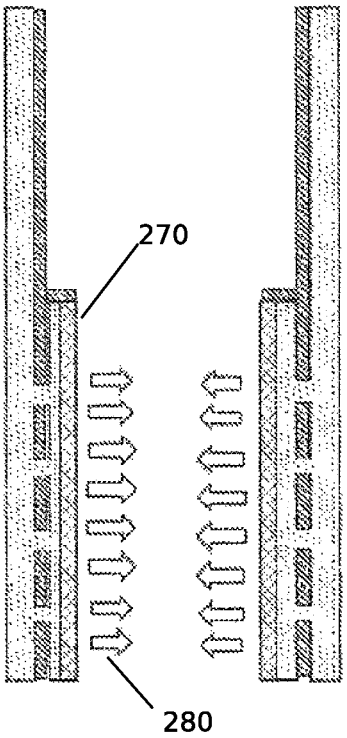

Reference is now made to FIG. 4, comprising FIGS. 4*a*, 4*b* and 4*c*, a series of schematic sections of a process of cleaning a sand screen 270 using a tool 210 to enhance oil production according to another embodiment of the present invention.

The sand screen 270 sits in front of a perforated section 272 of wellbore casing 214. Hydrocarbons in the formation 274 flow through the perforated casing 272 and into the wellbore 276 after passing through the sand screen 270. The purpose of the sand screen is to filter out sand and other debris 2788 from the hydrocarbons. Over time, the screen 270 becomes blocked.

Referring to FIG. 4*b*, a tool 210 very similar to the tool 10 of the first embodiment uses a propellant source 212 to create a high pressure jet of combustion products 228 which exits the tool 212 through a circumferential nozzle 234. The high pressure jet of combustion products 228 creates a vibration in the screen 270 and applies heat to the screen 270 which has the effect of clearing the debris 278 from the screen 270 allowing greater volumes of hydrocarbon to flow through the screen 270 as can be seen in FIG. 4*c*.

Figure 5:
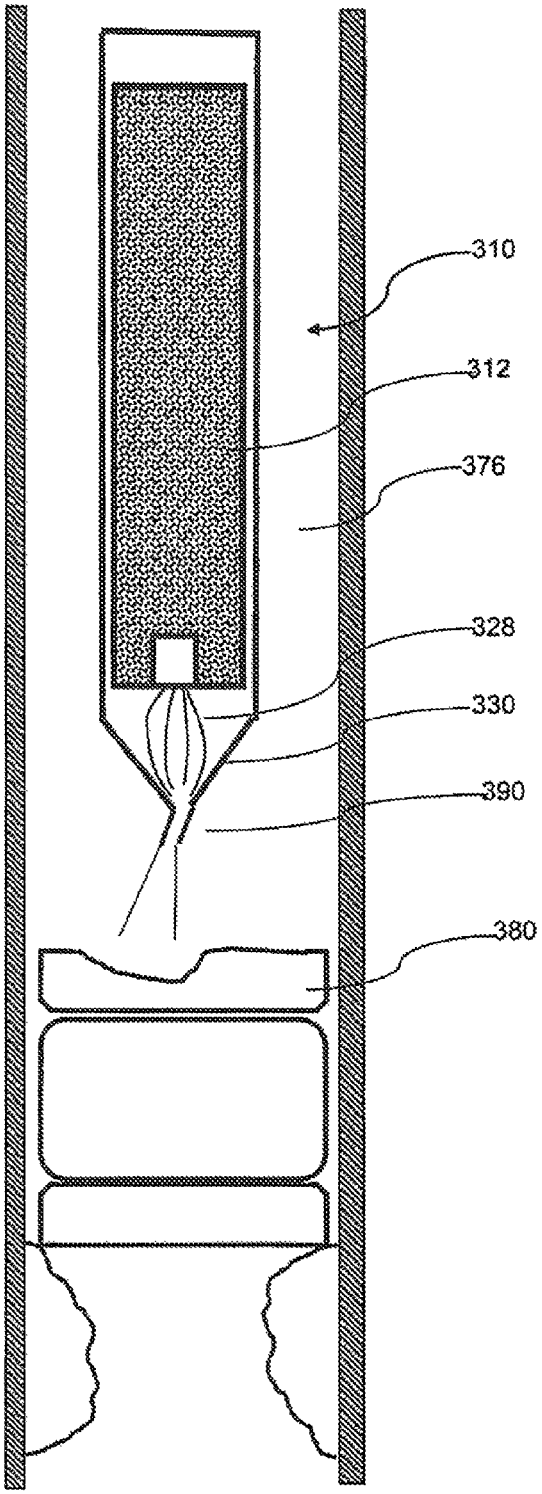
FIG. 5 is a section of a tool comprising a propellant source removing an obstruction in a pipeline according to another embodiment of the present invention.

Referring to FIG. 5, a schematic section of the tool 310 comprising a propellant source 312 for removing a wellbore obstruction 380.

In this embodiment, the tool 310 has a flow path 330 which directs the combustion products 328 axially downwards through a computer-controlled nozzle 390. The nozzle 390 can be remotely controlled to remove the obstruction 380, through cutting, melting, chemically changing or other means, and clear the wellbore 376.

It will be understood that although most of the applications of the present invention have been discussed in relation to oil wells, other suitable applications to initiate changes to targets in remote locations could be unrelated to oil wells, for example, in subsea applications, for cutting, welding or any other transformation of subsea infrastructure or equipment, for example when used in combination with an remote operated subsea vehicle; in high or difficult to access locations, by coupling a tool with a propellant source to a flying device, such as a drone or helicopter, or to a portable device, such as a hand-held gun. To monitor the progress of an operation, cameras or other sensors could also be built into the devices.

Figure 6:
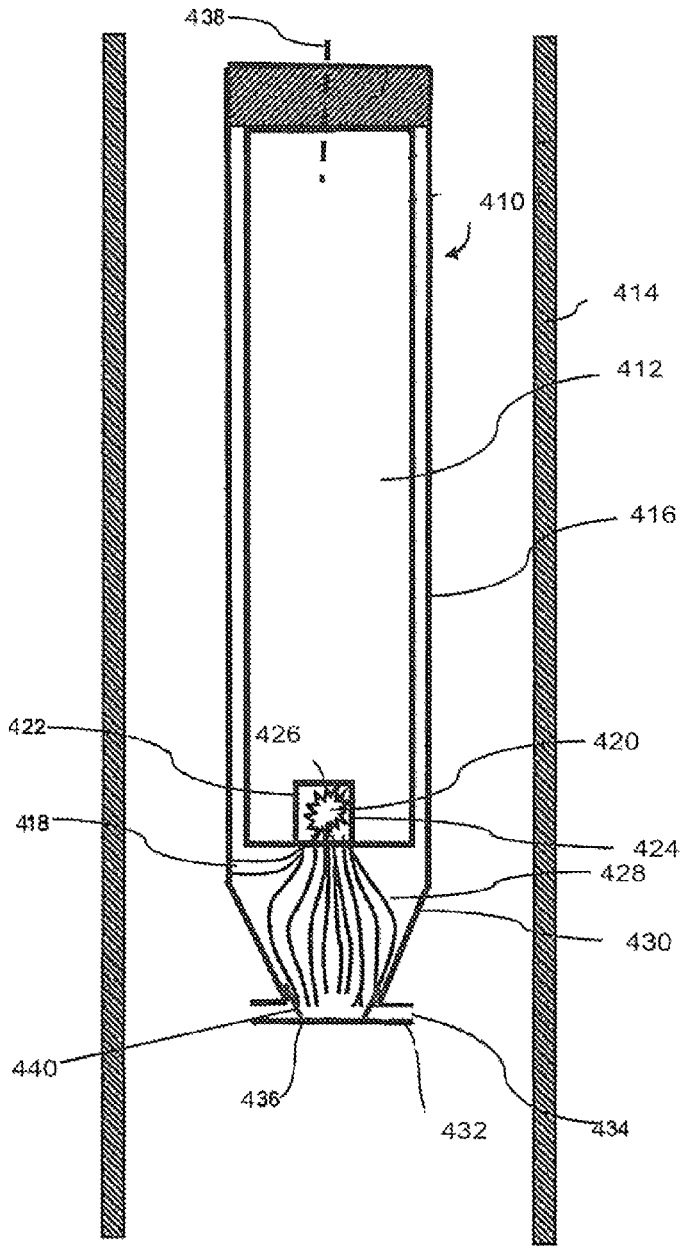
FIG. 6 shows a schematic section of a tool comprising a propellant source cutting a casing according to a further embodiment of the invention.

Reference is now made to FIG. 6 which shows a schematic section of a tool 410, comprising a propellant source 412 for cutting a casing 414 according to a further embodiment of the present invention.

The propellant source 412 is housed within a tool body 416. The tool 410 further includes an ignition mechanism 418 for igniting the propellant source 412. The propellant source 412 includes a cylindrical ignition recess 422 where the ignition mechanism ignites the propellant source 412. In FIG. 6 the propellant source 412 has already been ignited creating a combustion zone 420 inside the ignition recess 422. Particularly the ignition recess sidewall 424 and end wall 426 are supporting propellant combustion.

This combustion produces combustion products 428 which, due to the combustion zone 420 being established inside the ignition recess 422, are propelled out of the ignition recess 422 and into a flow path 430 defined by the tool body 416. The ignition recess 422 essentially directs the flow of combustion products 428 into the flow path 430.

The flow path 430 narrows to a nozzle head 432 with a circumferential nozzle 434, the flow path 430 is sealed by a frustoconical seal 440 which prevents the combustion products exiting through the nozzle 434. The combustion products 428 are contained within the flowpath 430 until a threshold pressure is reached which breaks the seal 440, thereby opening the flowpath 430.

The combustion products 428 are directed by the nozzle 434 out of the tool 410 at 90° to a tool longitudinal axis 438 and onto casing 414 from which material is removed.

The invention claimed is:

1. A method of removing material from a target, the method comprising the steps of:

providing a tool, the tool having at least one propellant source; wherein the propellant is an explosive material having a low rate of combustion that once ignited burns or otherwise decomposes to produce propellant gas and other combustion products as a stream of combustion products at high pressure;

igniting propellant of at least one of the propellant source(s) to form a combustion zone producing a stream of combustion products;

pressurising the tool with the stream of combustion products to a pressure higher than an environmental pressure, and directing at least one jet of combustion products generated at the combustion zone along at least one tool flow path;

wherein the tool flow path(s) is (are) closed by a seal until selectively opened by a threshold pressure of the stream of combustion products, that breaks the seal;

whereupon the at least one jet of combustion products exiting the tool flow path(s) interacts with a target, the interaction causing material to be removed from the target.

2. The method of claim 1, wherein material is removed from the target by ablation, erosion, impacting, cleaning and/or transmitting heat to the target.

3. The method of claim 2, wherein ablation, erosion, impacting and/or cleaning the target and/or transmitting heat to the target removes material from the target by severing, crushing, vibrating, skimming, applying a pressure to, hitting the target, propelling or moving and/or melting the target.

4. The method of claim 1, wherein the at least one jet of combustion products create a chemical reaction in the target.

5. The method of claim 1, wherein the step of directing at least one jet of combustion products generated at the combustion zone along at least one tool flow path, is at least partially continuous.

6. The method of claim 1, wherein the flow path defines a flow path profile, the flow path profile being configured to create a change in a combustion product parameter.

7. The method of claim 6, wherein the flow path is configured to change the pressure, temperature and/or speed of the at least one jet of combustion products.

8. The method of claim 1, wherein there are multiple flow paths.

9. The method of claim 8, wherein, where there are multiple flow paths, at least some of the flow paths converge into a single flow path.

10. The method of claim 1, wherein, where there is a single flow path, the single flow path diverges into multiple flow paths.

11. The method of claim 1, wherein the flow path(s) has a variable cross-section.

12. The method of claim 1, wherein the flow path(s) includes one or more restrictions.

13. The method of claim 12, wherein the restriction(s) are movable with respect to the flow path(s) to create pulses in the at least one jet of combustion products.

14. The method of claim 12, wherein the restriction(s) define a reduced flow path(s) cross section.

15. The method of claim 12, wherein the restriction(s) define a varying flow path cross section.

16. The method of claim 1, wherein the method further comprises the step of providing at least one additive.

17. The method of claim 16, wherein the additive(s) is a heat transfermaterial.

18. The method of claim 16, wherein the method comprises the step of introducing the additive(s) to the generated at least one jet of combustion products.

19. The method of claim 18, wherein the additive(s) are introduced to the at least one jet of combustion products through a feed.

20. The method of claim 1, wherein the propellant source generates the at least one jet of combustion products at high temperature.

21. The method of claim 1, wherein the generated at least one jet of combustion products exits the flow path in a preferred direction.

22. The method of claim 1, wherein the method further comprises the step of moving the tool with respect to the target, after the propellant has been ignited to produce combustion products.

23. The method of claim 1, wherein the method comprises the step of varying the direction of the at least one jet of combustion products exiting the flow path with respect to the tool, after the propellant has been ignited to produce combustion products.

24. The method of claim 1, wherein the angle and/or direction of the at least one jet of combustion products exiting the flow path is controlled by computer numerical control methods.

25. The method of claim 1, wherein the method comprises the step of directing the at least one jet of combustion products generated at the combustion zone in a radially outwards direction.

26. The method of claim 1, wherein the method comprises the step of deflecting the at least one jet of combustion products prior to exiting the flow path.

27. The method of claim 25, wherein the at least one jet of combustion products is deflected by a deflector.

28. The method of claim 27, wherein the deflector is sacrificial.

29. The method of claim 28, wherein the deflector comprises an additive.

30. The method of claim 1, wherein the method comprises forming a plurality of jets of combustion products.

31. The method of claim 1, wherein the method comprises merging one or more jets of combustion products to form a single jet of combustion products.

32. The method of claim 1, wherein the method comprises creating pulses in the generated at least one jet of combustion products.

33. The method of claim 1, wherein the method comprises creating a sequence of jets of combustion products.

34. The method of claim 32, wherein the sequence of jets of combustion products are pulses.

35. The method of claim 1, wherein the method comprises the step of cooling the target.

36. The method of claim 1, wherein the method comprises subjecting the target to thermal stress and/or thermal shock imparted partially with the generated at least one jet of combustion products.

37. The method of claim 1, further comprising a step of monitoring the removal of material from the target.

38. The method of claim 37, wherein the step of monitoring the removal of material from the target is performed by a camera.

39. The method of claim 1, wherein the at least one jet of combustion products interacts directly with the target.

40. The method of claim 1, wherein the at least one jet of combustion products interacts indirectly with the target.

41. The method of claim 1, wherein the at least one jet of combustion products is adapted to propel an object or material into, adjacent to or through the target.

42. A tool for removing material from a target, the tool comprising:

at least one propellant source;

at least one mechanism for igniting propellant of the propellant source(s), wherein the propellant is an explosive material having a low rate of combustion that once ignited burns or otherwise decomposes to produce propellant gas and other combustion products as a stream of combustion products at high pressure;

wherein, upon ignition, propellant of at least one of the propellant source(s) combusts to form a combustion zone producing the stream of combustion products; and the tool further comprises;

at least one tool flow path, the tool flow path(s) being closed by a seal and selectively openable by a threshold pressure of the stream of combustion products, that breaks the seal;

wherein the stream of combustion products pressurises the tool to a pressure higher than the environmental pressure, opens the tool flow path(s) and directs at least one jet of combustion products, in use, to flow out of the tool along the tool flow path(s) towards a target from which material is to be removed.

43. The method of claim 1 wherein the tool flow path(s) are selectively closeable, after the propellant has been ignited to produce combustion products.

44. The tool of claim 42 wherein the tool flow path(s) are selectively closeable, after the propellant has been ignited to produce combustion products.

45. The tool of claim 42 wherein the propellant of the propellant source(s) does not contain an additive.

46. A method of removing material from a target, the method comprising the steps of:

providing a tool, the tool having at least one propellant source;

wherein the propellant is an explosive material having a low rate of combustion that once ignited burns or otherwise decomposes to produce propellant gas and other combustion products as a stream of combustion products at high pressure, and wherein the propellant of the propellant source or propellant sources does not contain an additive;

igniting propellant of at least one of the propellant source (s) to form a combustion zone producing a stream of combustion products;

pressurising the tool with the stream of combustion products to a pressure higher than an environmental pressure, and directing at least one jet of combustion products generated at the combustion zone along at least one tool flow path;

wherein the tool flow path(s) is (are) closed by a seal until selectively opened by a threshold pressure of the stream of combustion products, that breaks the seal;

whereupon the at least one jet of combustion products exiting the tool flow path(s) interacts with a target, the interaction causing material to be removed from the target.

* * * * *